US006425405B1

(12) United States Patent
McRoberts

(10) Patent No.: US 6,425,405 B1
(45) Date of Patent: Jul. 30, 2002

(54) SNAP ON PONY TAIL HOLDER/ANCHOR RING

(76) Inventor: Michael J. McRoberts, 22835-C Savi Ranch Pkwy., Yorba Linda, CA (US) 92807

( * ) Notice: Subject to any disclaimer, the term of this patent is extended or adjusted under 35 U.S.C. 154(b) by 0 days.

(21) Appl. No.: 09/815,761

(22) Filed: Mar. 26, 2001

(51) Int. Cl.[7] ..... A45D 8/04

(52) U.S. Cl. ..... 132/275

(58) Field of Search ..... 132/275, 273

(56) References Cited

U.S. PATENT DOCUMENTS 4,785,834 A * 11/1988 Gonzalez ..... 132/275
5,730,161 A * 3/1998 Kohanek ..... 132/273
5,893,377 A * 4/1999 Chen ..... 132/275
5,901,713 A * 5/1999 Mroczek ..... 132/275
6,189,543 B1 * 2/2001 Sonstegard ..... 132/275
6,260,555 B1 * 7/2001 Matvig ..... 132/273

* cited by examiner

*Primary Examiner*—Todd E. Manahan
(74) *Attorney, Agent, or Firm*—Cleveland R. Williams, III

(57) ABSTRACT

The present invention discloses a hair fastening and ornamental device for use in securing strands of hair in place on an individuals head. The device comprises, in combination, a flexible, resilient anchor ring for encircling and holding strands of hair, wherein the anchor ring has snap on means and a pony tail holder with snap on means for removably mating with the snap on means of the anchor ring. The pony tail holder comprises a flexible, elongated, rectangular shaped configuration having securing means on opposite and opposing edges of the two longer sides thereof, for removably interconnecting said edges to from a circular configuration of said pony tail holder for holding in place strands of hair. The pony tail holder has an inside section and an outside section with snap on means located on the inside section thereof for being removably attached to the anchor ring. The outside section or wall of the pony tail holder contains one or more snap on units for removably receiving a decorative device.

10 Claims, 3 Drawing Sheets

SNAP ON PONY TAIL HOLDER/ANCHOR RING

BACKGROUND OF THE INVENTION

1. Field of the Invention

Substantial segments of the human population prefer to let their hair grow long. This concept has been particularly true of young women. In recent or modern times this concept is also true among men. In the past, many such individuals, especially women, styled their hair into a single, or occasionally a double strand and used various devices to hold them into a desired style.

Other patterns or styles for long hair included braiding the hair into one or more pigtails wherein an ornament device was used at the end of the pigtails, for example, a ribbon, metal or plastic ring to hold the bundle of hair in a single strand.

More recently, men and women allow their hair to grow long and frequently fashion their hair into a uni-sex type style, where the hair is formed into a strand of hair or ponytail.

The present invention resides in a snap on pony tail holder/anchor ring which is adapted to be placed around a lock of hair or hair strands to hold said pony tail or hair strands in a secure relationship. The pony tail holder/anchor ring has snap on means for quickly and easily securing or removing the holder/anchor ring to or from a decorative device or accessory as it surrounds a pony tail, strands of hair or dread locks. The snap on pony tail holder/anchor ring is additionally adapted to receive a variety of snap on decorative ornaments on the outside surface thereof. In an alternative mode, the anchor ring has snap on means to receive an ornament or decorative device.

2. Description of the Prior art

Numerous hair fastening devices exist for holding hair in a particular orientation on the human head and the prior art disclose and teach a variety of methods and devices for holding hair, such as, pony tails in a desired manner or fashion.

For example, U.S. Pat. No. 5,730,161 to Kohanek discloses a hair fastening device and method of holding hair in place. The device consists of an elongated cylindrically shaped, hair fastener which is adapted to enclose a ponytail or the like. The hair fastener has hooking means located on the interior thereof. The hair fastener is held in place by attaching the hooking means to a conventional hair-fastening device.

U.S. Pat. No. 5,878,756 to Bilodean relates to an athletic hair tie, which consists of an elongated tubular hair sleeve constructed from a flexible material. The hair tie is suitable for encompassing the hair of a user. The hair sleeve contains a plurality of securement mechanisms situated along a length of the sleeve for securing the sleeve about and/or around the hair of the user.

U.S. Pat. No. 5,411,040 to Forrest teaches a fabric hair curler which includes a receiving area for hair and elements for restraining laterally the hair placed in the receiving area. First and second fabric tie strips are positioned below restraining elements and extend laterally from opposite edges of the body with sufficient length to be in tied relationships when hair restrained by the panels in the receiving area is rolled longitudinally with the body in a curl. The design makes the hair curler easy to use, manipulate and tie and makes it comfortable to wear during waking and sleeping hours.

U.S. Pat. No. 5,365,954 to Rude discloses a hairdressing tool that consists of an ornamental device for placement in longhair arrangements. The device is constructed with a pin to prevent slippage of the device on the hair.

U.S. Pat. No. 5,293,884 to Chapman et al relates to a loop strap hair tie, which is described as suitable to fasten locks of hair into ponytails, braids or dread locks. The hair tie consists of a generally planar, elongated material containing corresponding fastening surfaces at each end. The hair tie encircles a lock of hair in a belt-like fashion and fastens upon itself. The hair tie is capable of trying different amounts of hair by varying the positions the ends of the hair tie engage. The hair tie, in addition, incorporates an elastic loop and a friction pad to ensure the hair tie is securely attached and remains in position on the lock of hair. Ornamentation such as beads, jewelry, ribbon, paintings and logos may decorate the hair tie, allowing individuals to decorate their hair as well as fasten it.

U.S. Pat. No. 5,156,171 to Goodman teaches a ponytail holder containing a relatively wide fabric ring having a tubular annulus around a central hole, including an elastic ring in the tubular annulus. The elastic ring contains a portion that is readily grasped, as by having a knob such as a bead, for pulling a loop of the elastic ring outside of the fabric ring. The fabric ring is particularly designed to encircle a ponytail.

U.S. Des. Pat. No. 397,510 to Sears discloses an ornamental design for a hair fastener which includes a rectangular shaped configuration consisting of gathered fabric having combs on opposing ends of the underside of the rectangular shaped configuration.

U.S. Des. Pat. No. 364,705 to Frame et al discloses an ornamental design for a hair accessory consisting of a circular configuration, which defines a cavity therein. The hair accessory has elastic ring on opposing ends thereof for receiving a strand of hair.

As can readily be determined from the foregoing, there is an ongoing research effort to produce new and novel hair accessories for both male and female individuals.

SUMMARY OF THE INVENTION

The present invention resides in a hair fastening and ornamental device for securing strands of hair in place comprising in combination: a flexible, resilient, anchor ring for encircling and holding stands of hair, said flexible, resilient ring having snap on means; and a flexible, elongated, rectangular shaped pony tail holder having securing means on opposite and opposing edges and adjacent to the edges thereof, for removable interconnecting said edges to form a circular configuration of said pony tail holder for holding in place strands of hair, said pony tail holder having an inside section and an outside section and snap on means located on the inside section thereof for being removable attached to the anchor ring.

BRIEF DESCRIPTION OF THE DRAWINGS

The invention will be better understood when consideration is given to the below-described detail description, which makes reference to the annexed drawings wherein.

DETAILED DESCRIPTION OF THE INVENTION

Figure 1A:
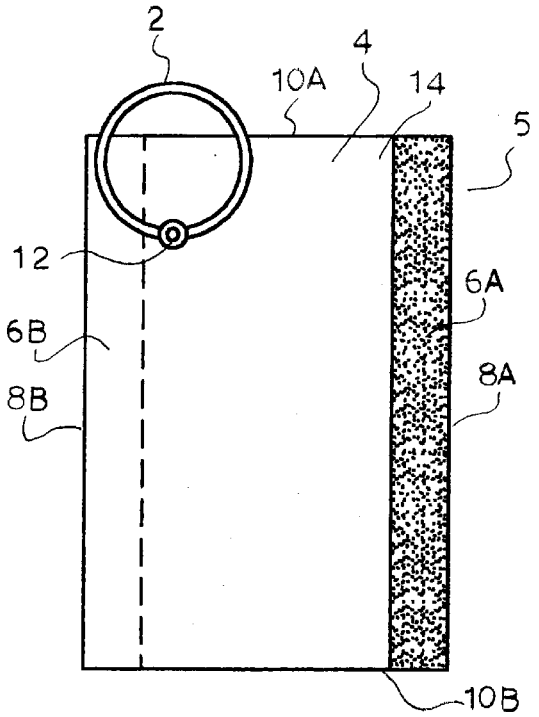
FIG. 1A is a back view of the pony tail holder snapped onto the anchor ring in an open position. The pony tail holder has VELCRO® securing means on the edges thereof.

The present invention resides in a hair fastening and ornamental device for use in securing strands of hair in place on an individual's head.

Embodiments of the hair fastening and ornamental device are hereinafter described with reference to the drawings, in which identical or corresponding parts are indicated by the same reference characters or numbers through the several views.

FIG. 1A illustrates a back view of the hair fastening and ornamental device 5 showing in combination the inside section 14 of pony tail holder 4 attached to anchor ring 2 with snap on means 12. Snap on means 12 comprises a female snap on unit (not shown) attached to pony tail holder 4 and a male snap on unit (not shown) attached to anchor ring 2, the two of which are removable, attached to each other to form snap on means 12.

Pony tail holder 4 is a flexible, elongated rectangular shaped configuration with top portion 10A and bottom portion 10B having a shorter length than right side 8A and left side 8B. VELCRO® securing means 8 (A and B) removable secure pony tail holder 4 when in a closed position. (see FIG. 1B).

Pony tail holder 4 is constructed from a flexible material selected from the group consisting of leather, lycra, neoprene, nylon; canvas, silk, cloth, other textiles and mixtures thereof. The preferred material from which pony holder 4 is constructed consists of leather.

Anchor ring 2 is constructed from a flexible, resilient rubber-like material that can easily be stretched without loosing the integrity of its circular configuration. Accordingly, suitable materials from which anchor ring 2 can be constructed include rubber, pliable neoprene, pliable plastic and mixtures thereof.

Figure 1B:
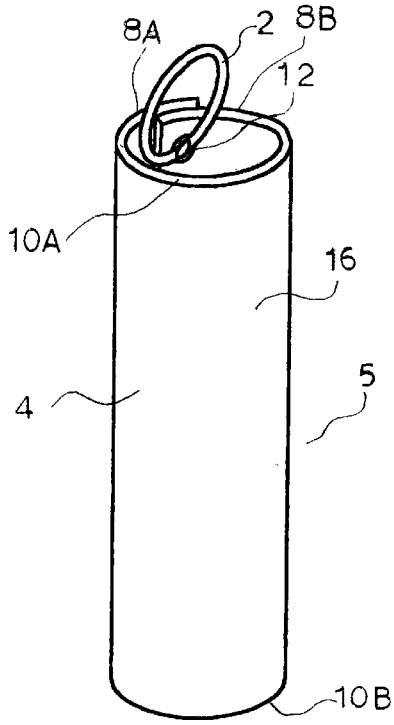
FIG. 1B is a front perspective view of the anchor ring and pony tail holder of FIG. 1A, wherein the pony tail holder is in a closed, circular position.

FIG. 1B is a front view of the hair fastening and ornamental device of FIG. 1A showing the outer side 16 of pony tail holder 4, wherein pony tail holder 4 is in a closed circular configuration utilizing velcro securing means (not shown) described in FIG. 1A. Right side 8A is superimposed on left side 8B and held in place by VELCRO® securing means as shown and described in FIG. 1A.

Anchor ring 2 is removable secured to pony tail holder 4 by snap on means 12. It is to be noted that, in use, a strand of human hair passes through anchor ring 2, into the top 10A and out the bottom 10B of ponytail holder 4.

Figure 2A:
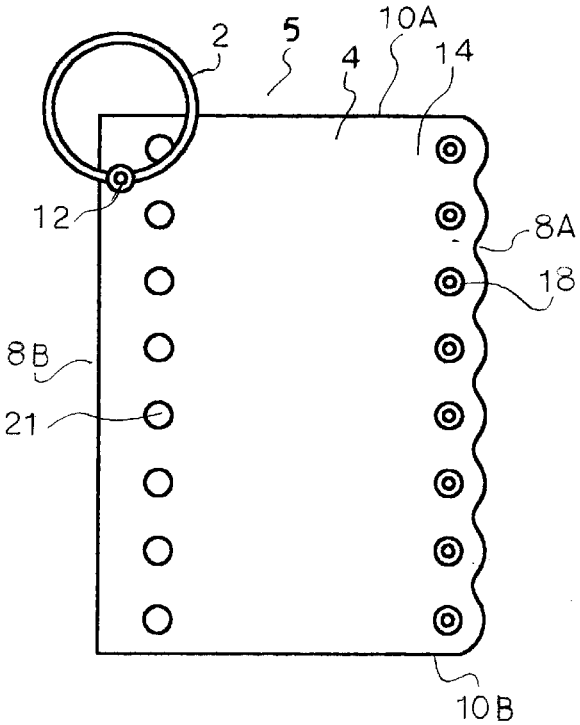
FIG. 2A is another back view of the pony tail holder snapped onto the anchor ring in an open position. The pony tail holder has snap on securing means on the edges thereof.

FIG. 2A is a back view of FIG. 1A showing substantially the same features with the following exceptions: The securing means for removably attaching right side 8A to left side 8B to form a circular configuration of ponytail holder 4 comprises a plurality of male snap on units 18 and a plurality of female snap on units 21. The number of snap on units 18 and 21 are from about 2 to about 21 units, especially from about 2 to about 12 units, preferably from about 2 to about 8 units. It is to be noted that male snap on units 18 can be located on right side 8A and female snap on units 21 can be located on left side 8B of pony tail holder 4.

In use, male snap on unit 18 engages female snap on unit 21 in a removably connected configuration of ponytail holder 4 for receiving a strand of hair.

Figure 2B:
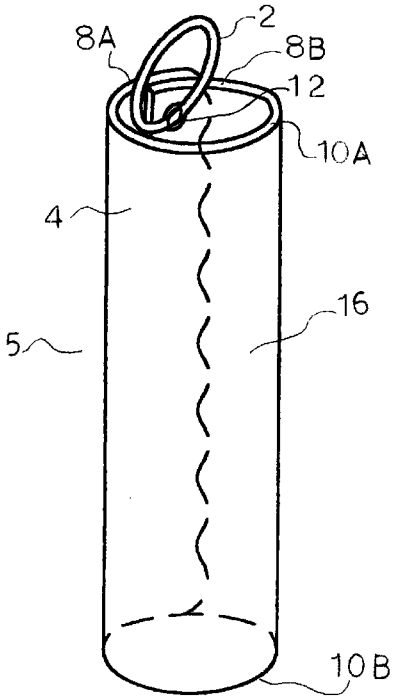
FIG. 2B is a front perspective view of the pony tail holder and anchor ring of FIG. 2A, where the pony tail holder is in a closed, circular configuration.

FIG. 2B is a front view of the hair fastening and ornamental device 5 shown in FIG. 1B with the following exceptions:

Male snap on units 18 and female snap on units 20, as shown in FIG. 2A, are utilized to removable secure pony tail holder in a closed circular configuration in place of velcro securing means 8A and 8B (not shown).

Figure 3A:
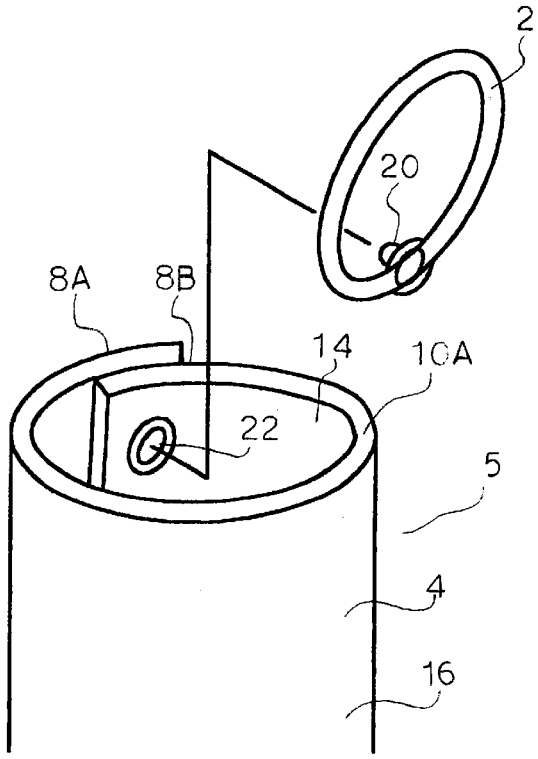
FIG. 3A is a front, exploded-partial view of the pony tail holder and anchor ring of FIG. 2A showing the female snap on unit connected to and located on the inside section of the pony tail holder near the upper portion thereof. The anchor rings contains a male snap on unit for removable joining with the female snap on unit located on the pony tail holder.

FIG. 3A is a partial, front exploded view of the hair fastener and ornamental device 5 of FIG. 2B with the following exceptions:

The inside section or wall 14 of pony tail holder 4 has female snap on unit 22 attached thereto near the top portion thereof. Anchor ring 2 has male snap on unit 20 attached to it. The male snap on unit 20 attached to anchor ring 2 removably engages female snap on unit 22 attached to pony tail holder 4 to secure the two together.

Figure 3B:
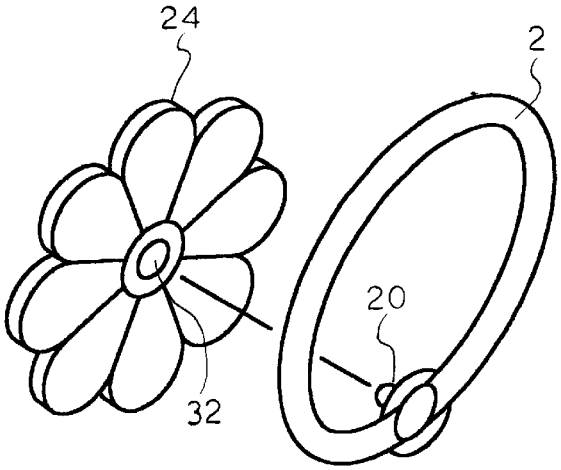
FIG. 3B is an exploded view of the anchor ring and a decorative flower with snap on means.

FIG. 3B is a front perspective view of yet another embodiment of this invention wherein anchor ring 2 containing male snap on unit 20 is in an exploded configuration with female snap on unit 22 which is attached to decorative flower device 24.

In use anchor ring 2 is removably attached to decorative device 24 using male and female snap on units 20 and 32. Anchor ring 2 is removably placed around a strand of hair.

Figure 3C:
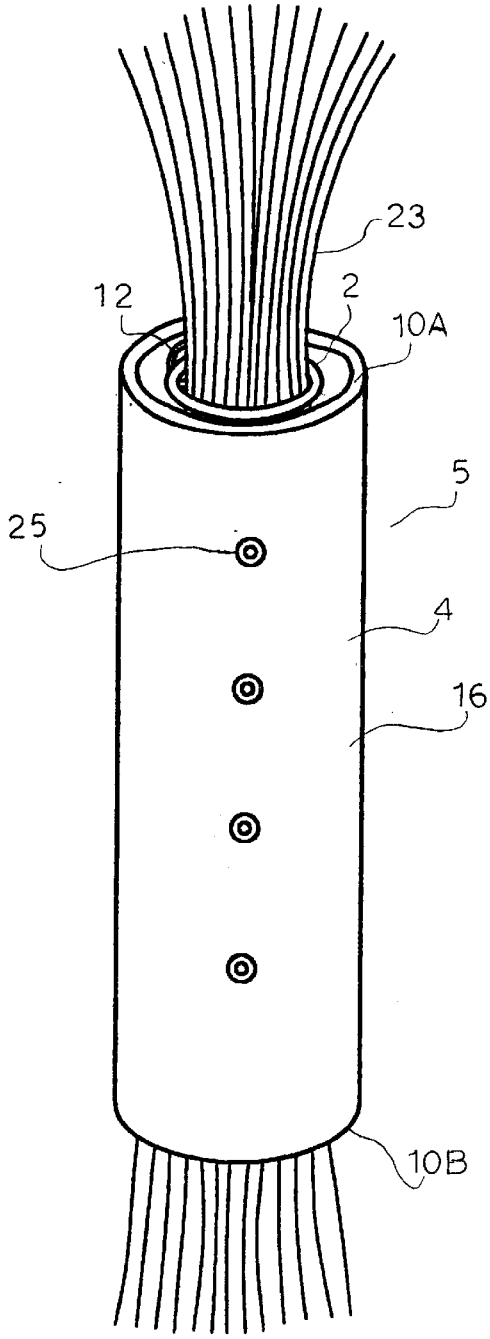
FIG. 3C is a front perspective view of the pony tail holder attached to the anchor ring with snap on means in a closed, circular position and surrounding a strand of hair.
Figure 4A:
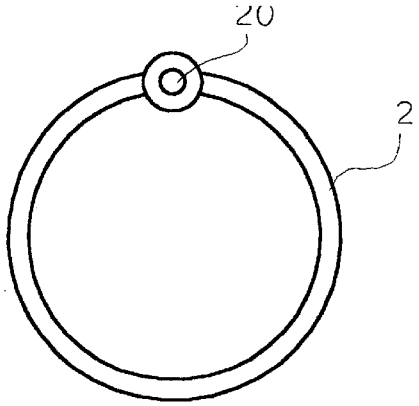
FIG. 4A is a front view of the anchor ring with a male snap on unit attached thereto.
Figure 4B:
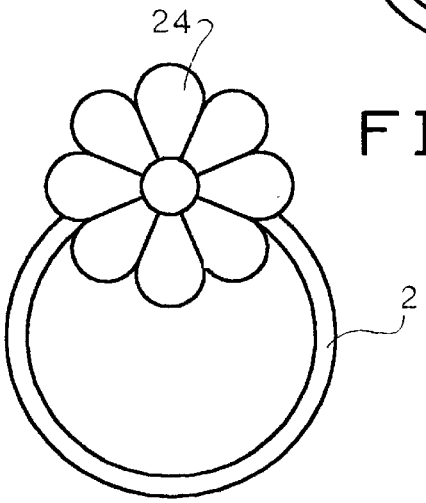
FIG. 4B is a front view of the anchor ring attached to a decorative flower device with snap on means.
Figure 4C:
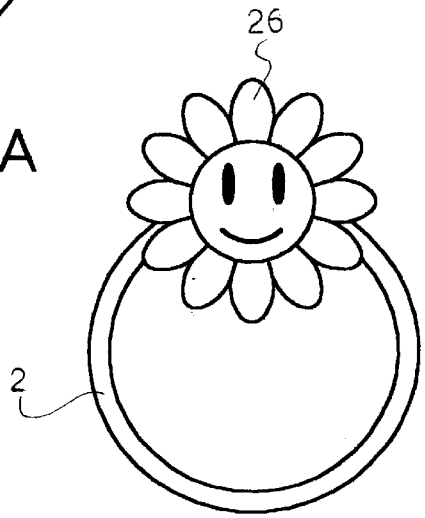
FIG. 4C is another front view of the anchor ring attached to a decorative, happy face flower device with snap on means.
Figure 4D:
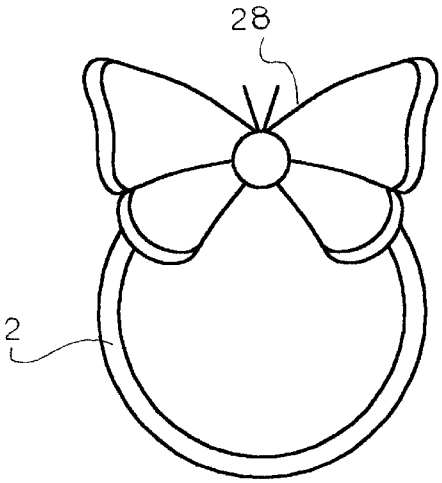
FIG. 4D is still another front view of the anchor ring attached to a decorative butterfly device with snap on means.
Figure 4E:
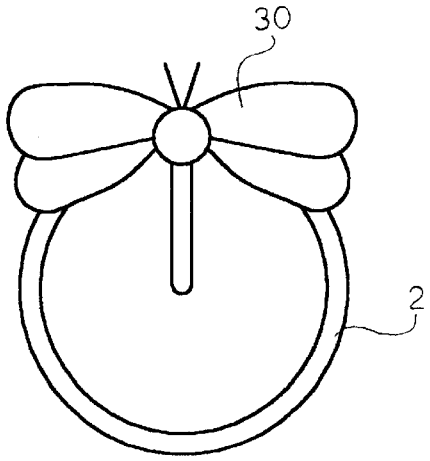
FIG. 4E is yet another front view of the anchor ring attached to a decorative dragonfly device with snap on means.

FIG. 3C is a front perspective view of the hair fastening and ornamental device 5 shown in FIG. 2 with the following exceptions: A strand of hair 23 passes through anchor ring 2, and through the top 10A and bottom 10B of pony tail holder 4. Snap on units 25 are located on the outside section or wall 16 in a centered position on pony tail holder 4 for receiving decorative devices (not shown). Snap on units 25 can be either male snap or units or female snap on units depending upon the type snap on unit utilized by the decorative devices. The number of snap on units 25, located on the outside wall 16 of pony tail holder 4 can vary from about 1 to about 8, especially from about 1 to about 6, preferably from about 1 to about 4 units.

FIG.4 A is a front view of anchor ring 2 showing male snap on unit 20. FIGS. 4B to 4E show respective views with decorative devices attached to anchor ring 2. For example, decorative flower 24, happy face flower 26, butterfly 28, and dragon fly 30, devices are shown attached to anchor ring 2.

It is to be noted that the decorative devices can be attached to the outside wall 16 of pony tail holder 4 utilizing snap on units 25.

Obviously, many modifications and variations of the invention, as herebefore set forth, may be made without departing from the spirit and scope thereof, and therefore, only such limitations should be imposed as are indicated in the appended claims.

I claim:

1. A hair fastening and ornament device for securing strands of hair in place comprising in combination: a flexible, resilient, anchor ring for encircling and holding stands of hair, said flexible, resilient anchor ring having snap on means; and a flexible, elongated, rectangular shaped pony tail holder having securing means on opposite and opposing edges and adjacent to the edges thereof, for removable interconnecting said edges to form a circular configuration of said pony tail holder for holding in place strands of hair, said pony tail holder having an inside section and an outside section and snap on means located on the inside section thereof for being removable attached to the anchor ring.

2. The hair fastening and ornamental device of claim 1, wherein the snap on means for the anchor ring is a male snap on unit and the snap on means for the pony tail holder is a female snap on unit.

3. The hair fastening and ornamental device of claim 1, wherein the snap on means for the anchor ring is a female snap on unit and the snap on means for the pony tail holder is a male snap on unit.

4. The hair fastening and ornamented device of claim 1, wherein the securing means on opposing edges of the pony tail holder is female snap on units on one edge and male snap on units on the opposite side of the other edge.

5. The hair fastening and ornamental device of claim 1, including snap on means on the outside section of the pony tail holder for removable attaching decorative devices having snap on means onto said pony tail holder.

6. The hair fastening and ornamental device of claim 5, wherein the snap on means include mating male and female snap on units, one snap on unit being located on the pony tail holder and the other snap on unit being located on the decorative device.

7. The hair fastening and ornamental device of claimed 5, wherein the snap on decorative device includes materials which resemble flowers, butterflies, happy faces, flags, dragonflies and mixtures thereof.

8. The hair fastening and ornamental device of claim 1, wherein the anchor ring is constructed from a flexible, resilient material selected from the group consisting of rubber, neoprene or pliable plastic and mixture thereof.

9. The hair fastening device of claim 1, wherein the pony tail holder is constructed from a flexible material selected from the group consisting of leather, lycra, nylon, canvas, neoprene, silk, cloth and mixtures thereof.

10. The hair-fastening device of claim 1, wherein the pony tail holder is constructed from leather.

* * * * *